United States Patent [19]

Lienert

[11] 4,337,632

[45] Jul. 6, 1982

[54] LEAF SPRING STRESS PEENING METHOD AND APPARATUS

[75] Inventor: Gerold Lienert, Georgetown, Canada

[73] Assignee: Rockwell International Corporation, Pittsburgh, Pa.

[21] Appl. No.: 158,732

[22] Filed: Jun. 12, 1980

[51] Int. Cl.[3] ..... B24C 1/10

[52] U.S. Cl. ..... 72/53; 51/418

[58] Field of Search ..... 72/53, 40; 51/418

[56] References Cited

U.S. PATENT DOCUMENTS

| | | | |
|---|---|---|---|
| 2,131,767 | 10/1938 | Turnbull | 51/418 |
| 2,252,823 | 8/1941 | Wallace | 72/53 |
| 2,835,129 | 5/1958 | Reiser | 73/161 |
| 3,004,584 | 10/1961 | Fuchs | 72/53 |
| 3,131,457 | 5/1964 | Correll | 72/53 |
| 3,520,086 | 7/1970 | Stevens | 51/418 |

*Primary Examiner*—Gene Crosby

[57] ABSTRACT

A leaf spring stress peening apparatus is composed of a first conveyor capable of transporting a plurality of leaf springs in an unstressed position. A second endless conveyor is provided to transport a plurality of leaf spring deflecting elements. The first and second conveyors are positioned so that the leaf springs on the first conveyor are deflected by the elements on the second conveyor in a shot peening area. A blast wheel is located in the shot peening area and is positioned to concentrate shot peening material on the side of the deflected spring which is in tension. The deflecting elements disengage the spring as it leaves the shot peening area.

7 Claims, 3 Drawing Figures

LEAF SPRING STRESS PEENING METHOD AND APPARATUS

BACKGROUND OF THE INVENTION

1. Field of the Invention

This invention relates to machines for shot peening workpieces and, more particularly, to machines for subjecting workpieces to stress peening processes. "Stress peening" refers to the operation of shot peening a part while it is statically stressed in the same direction as the stress which is to be sustained when the part is in service. Still more specifically, the present invention relates to machines for stress peening workpieces of the leaf spring type such as are currently employed in automotive vehicle suspension systems.

2. Description of the Prior Art

Leaf springs are conventionally fabricated by hot rolling or otherwise shaping spring steel or other spring material into the required shape. The ends of the blanks are then curled to form eyes for receiving the mounting shackle bolts. The blades are then heat treated to hardening temperature and then quenched and tempered. It has been determined that if the spring blade is now shot peened while under load, it will possess improved strength and life characteristics, whereby for a given weight suspension problem a spring of reduced size and weight may be successfully employed. The advantage of stress peening of leaf springs is well known in the art.

Various stress peening machines have been disclosed such as that shown in U.S. Pat. No. 3,131,457 dated May 5, 1964 to W. L. Correll et al. This patent discloses a stress peening machine which uses a large ram to deflect the spring while it is carried into the range of the shot peening equipment. A machine of this type is exceedingly complicated and expensive to manufacture. The stress peening machine of the present invention not only is much less complicated and cheaper to build but it can stress peen more springs in a given time than that shown in U.S. Pat. No. 3,131,457.

The testing device shown in U.S. Pat. No. 2,835,129 dated May 20, 1958 to G. C. Reiser et al. also shows a machine which can deflect springs using a hydraulic ram. This machine is not well suited to the high output requirement for the manufacture of automotive leaf springs.

SUMMARY OF THE INVENTION

The primary object of this invention is to provide an improved machine into which previously shaped and hardened tempered spring leaves may be loaded by mounting them in response onto a moving conveyor while in unstressed positions, whereupon they are automatically stressed and then carried into a shot peening area, and subsequently released from their stressed condition before delivery from the machine.

It is a further object of this invention to provide an improved leaf spring stress peening machine which can provide for the stress peening of large quantities of springs in a quick and economical fashion.

It is an additional object of this invention to provide a method for stress peening leaf springs in which all the movement is performed by a single drive.

It is still an additional object of this invention to provide a leaf spring stress peening machine which can operate without limit switches, solenoids and pneumatic cylinders.

It is yet an additional object of this invention to provide a leaf spring stress peening machine which allows great flexibility as to spring lengths, spring camber and the desired stress condition for various springs.

These and other objects of the invention are provided in a preferred embodiment thereof which includes an apparatus for stress peening leaf springs comprising a first conveyor including means for supporting and transporting a plurality of leaf springs thereon. A second conveyor is provided which includes means for deflecting and stressing each of the leaf springs as each leaf spring transverses a predetermined area. A blast cabinet including wheels are located in the predetermined area for shot peening the side of the deflected leaf spring which is in tension.

These and other objects of the present invention will become apparent to those skilled in the art by reading the following specification, reference being made to the accompanying drawings and the appended claims.

BRIEF DESCRIPTION OF THE DRAWINGS

The description herein makes reference to the accompanying drawings wherein.

DESCRIPTION OF THE PREFERRED EMBODIMENT

Figure 1:
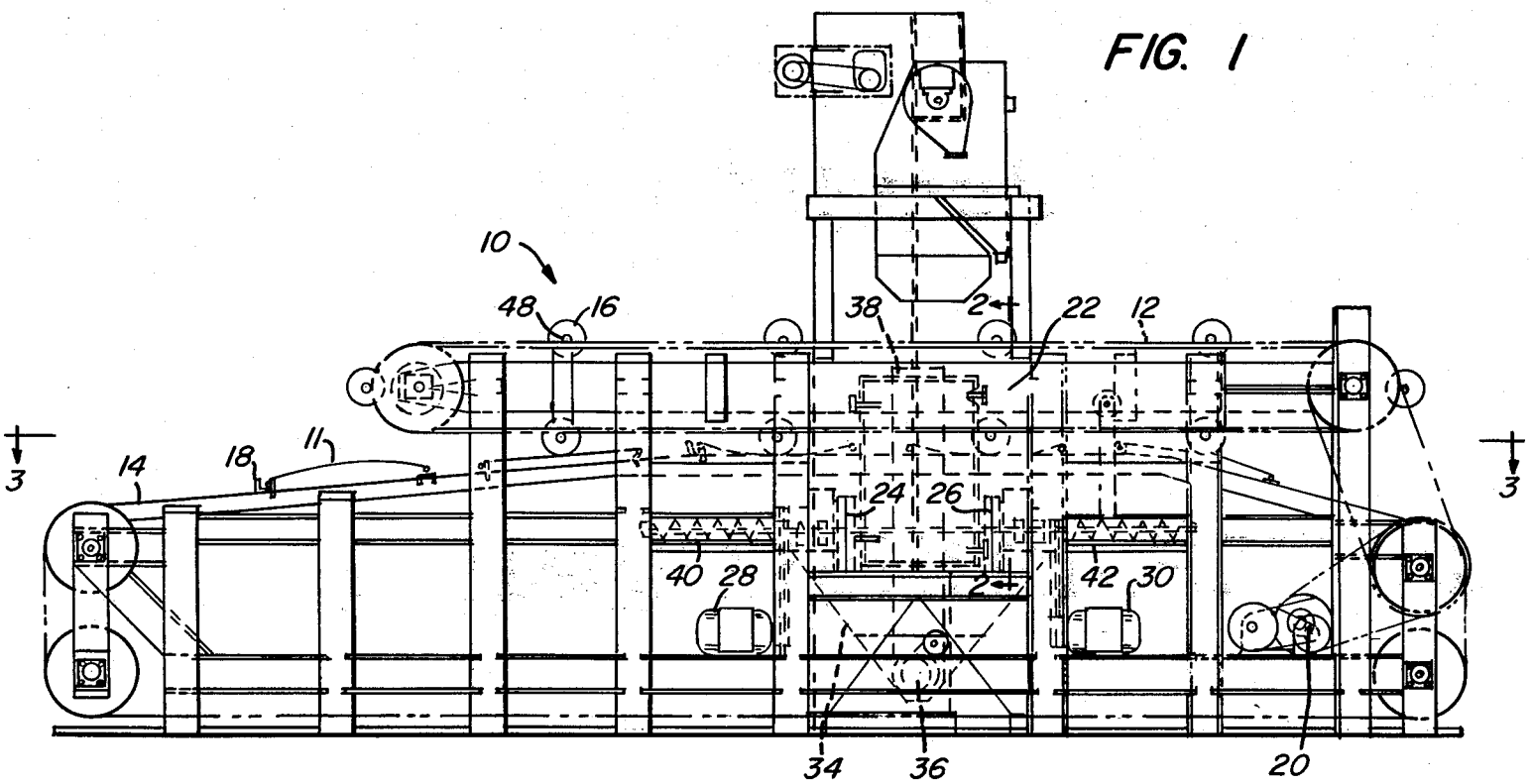
FIG. 1 is a side elevational view of the leaf spring stress peening machine.

Referring to FIG. 1, there is illustrated an elevational view of a high speed leaf spring stress peening machine generally denoted as 10. The machine 10 is comprised of a first conveyor 12 and a second conveyor 14. Conveyors 12 and 14 are located in line, with conveyor 12 located directly above conveyor 14.

In the preferred embodiment, conveyor 12 consists of a double strand chain carrier with deflection elements 16 mounted thereon. The preferred deflection elements are manganese steel rollers which will be described in greater detail below.

In the preferred embodiment, conveyor 14 is also composed of a double strand chain carrier equipped with fixtures adapted to hold the ends of a standard leaf spring. The preferred conveyor 12 contains ten deflection elements and conveyor 14 contains fifteen leaf spring fixtures.

A single power source 20 is used to drive both conveyors 12 and 14. Conveyors 12 and 14 are interlocked so that the motion of deflection elements 16 is synchronized with the movement of spring 11 when attached to fixture 18. The deflection element and the spring are spaced so that they engage one another in a predetermined area. The conveyors 12 and 14 are positioned vertically so that deflection element 16 fully deflects and stresses the spring 11 in this predetermined area. In the preferred embodiment, the interlocking of the two conveyors is accomplished by a mechanical drive means. If two separate motors were used to drive conveyors 12 and 14 respectively, interlocking could be accomplished in a non-mechanical way.

A blast cabinet 22 including blast wheels 24 and 26 are provided in the predetermined area where the springs 11 are deflected by the deflection elements 16. In the preferred embodiment, the two blast wheels 24 and 26 are located below conveyor 14 and rotate in a manner such that shot (not shown) is directed upwards toward the tension side of the deflected spring 11. In the preferred embodiment, each blast wheel 24 and 26 is powered by a separate motor 28 and 30. To insure that the up blasting shot is concentrated in the area of the springs, two rebound plates 31 and 33 are located above blast wheels 24 and 26 and below conveyor 14. The preferred blast cabinet 22 includes an integral shot reclaim hopper 34. The cabinet 22 is completely lined with one-half inch thick, 11–14% magnanese steel to withstand the rigors of the shot peening operation. The hopper 34 is provided with a screw conveyor 36 which conveys the shot peening material to a bucket elevator 38 for feeding the shot back into the blast wheels 24 and 26. The elevator 38 feeds a pair of screw conveyors 40 and 42 which feed blast wheels 24 and 26 respectively.

Figure 3:
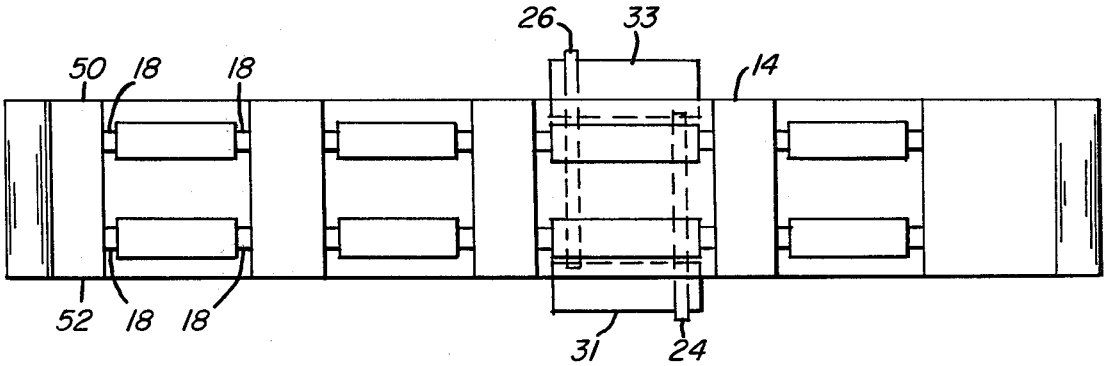
FIG. 3 is a plan view of the machine shown in FIG. 1 along the line 3—3.

As can be seen in FIG. 3, the preferred conveyor 14 is made up of two single strands of RC 140 chain 50 and 52 respectively. Conveyor 12 is of a similar design. On conveyor 14, the leading fixture 18 and trailing fixture 18 for each spring are bolted to chains 50 and 52. The fixtures 18 are relatively narrow thereby leaving an open area under the spring 11 between the leading and trailing fixtures. These fixtures are adapted to allow the mounting of a standard leaf spring thereto. Thus, in the preferred embodiment, two springs 11 may be placed in parallel on conveyor 14. The preferred spacing of the fixtures 18 is six feet from center to center. Conveyor 12 has force deflecting elements 16 also positioned at six foot centers. In the preferred embodiment, the deflecting elements 16 are made up of two metal discs which are mounted on spindles 48 thereby allowing the discs to turn. The spindles are welded to pads which are, in turn, bolted to each of the RC 140 chain strands.

Figure 2:
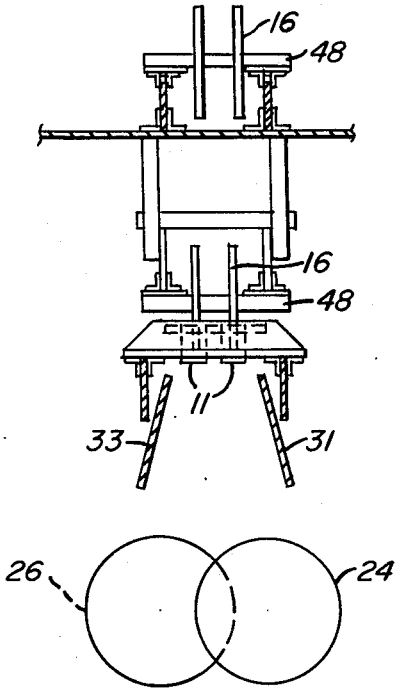
FIG. 2 is a sectional view of the machine shown in FIG. 1 along the line 2—2.

The operation of the leaf spring stress peening machine is as follows. The springs 11 are manually or automatically mounted on the fixtures 18 on conveyor 14. Once loaded, the springs move up an incline of approximately five degrees with their concave sides down at a speed of between fifteen to eighteen feet per minute. Immediately prior to entering the blast cabinet 22, the springs 11 engage the deflecting elements 16 on conveyor 14. As can be seen in FIGS. 1 and 2, the relative positions of the merging conveyors 12 and 14 produce the necessry deflection of springs 11. Various deflections can be produced up to a maximum of nine inchs in the vertical direction by changing the deflection disc diameters. These deflections cause stresses of 140,000 to 160,000 p.s.i. to develop on the surface of the spring which is in tension.

The springs 11 then enter the blast cabinet 22 where shot from wheel 24 and 26 contacts each of the two springs 11 mounted on the parallel chains 50 and 52. The deflecting plates 31 and 33 are provided to insure that the shot peening material is concentrated in the area of the springs.

After the springs 11 are conveyed, deflected and shot peened, they continue out of the blast area 22 and the conveyors 12 and 14 slowly diverge so as to releast the springs 11 from the deflection elements 16 and slowly release the springs for unloading. The unloading may be done either automatically or manually.

As spring lengths change, it is necessary to change the stress point. This is accomplished by releasing a locking mechanism on the drive of conveyor 12, positioning the deflection disc at the required stress point and reconnecting the drive. As both conveyors 12 and 14 travel at identical speeds with fixed attachment points equally distant one from the other, the stressing point will be constant and no further changes are required to accommodate different lengths of springs.

It should be noted that the above method for stress peening leaf springs can be altered without changing the basic concept of the invention. For instance, the conveyors could be interchanged putting conveyor 14 vertically above conveyor 12 and directing the shot downward at the leaf springs which are in tension.

While the preferred conveyor 14 transports two leaf springs 11 on fixtures located in parallel on each of the chains 50 and 52, it can be seen that a conveyor capable of transporting only one leaf spring 11 could be utilized with equal ease.

While, in the preferred embodiment, the deflection elements 16 are carried by conveyor 12, it is possible that a leaf spring stress peening machine of the present invention could be designed whereby conveyor 12 is eliminated and the deflection elements 16 are slidably mounted above conveyor 14 on a stationary fixture and engage the springs 11, move along with them and deflect them in the area of the blast cabinet 22 and then disengage the springs as the conveyor 14 angles downwardly from the fixture. The deflection elements 16 could then be quickly returned to engage the next spring in the cycle.

It can be seen that the present invention has provided a new and improved method and machine for stress peening automotive leaf springs. While only one example of the present invention has been described in detail, it should be understood to those skilled in the art of stress peening leaf springs that other forms may be added without departing from the spirit of the present invention or the scope of the appended claims. Therefore, without limitation in this respect, the invention is defined in the following claims.

I claim:

1. Apparatus for stress peening leaf springs comprising a conveyor including means for supporting and transporting a plurality of leaf springs thereon, means for deflecting and stressing each leaf spring as each leaf spring traverses a perdetermined area, means located in said predetermined area for shot peening the tension side of the deflected spring, a second conveyor transporting a plurality of said means for deflecting and stressing said leaf springs, and means for interlocking the movement of said second conveyor with said conveyor supporting and transporting said leaf springs to provide said deflection as said leaf springs traverse said predetermined area.

2. Apparatus for stress peening leaf springs as set forth in claim 1, wherein said second conveyor is vertically spaced from said first conveyor and a portion of the path of travel of at least one of said conveyors is elevated to effect initial contact between said leaf springs and said means for deflecting and stressing said leaf springs.

3. Apparatus for stress peening leaf springs as set forth in claim 2, wherein the paths of travel of each of said conveyors after said initial contact is effected are substantially parallel until the entire length of said leaf springs completely traverse said predetermined area.

4. Apparatus for stress peening leaf springs as defined by claim 2, wherein said means for deflecting and stressing said leaf springs comprises a plurality of rotatable discs carried at predetermined spaced locations by said second conveyor.

5. Apparatus for stress peening leaf springs are set forth in claim 2, wherein said first conveyor is comprised of two endless chains in parallel with the ends of said leaf springs mounted for said deflection and said shot peening to occur in the relatively open space around said chains.

6. Apparatus for stress peening leaf springs comprising:

a first endless chain conveyor including means for supporting and transporting a plurality of leaf springs thereon;

a second endless chain conveyor including means for supporting and transporting a plurality of spring deflecting elements thereon;

said first and said second conveyors being positioned so that said leaf springs on said first conveyor are deflected by said deflecting elements on said second conveyor in a predetermined area; and means located in said predetermined area for shot peening the tension side of said deflected leaf springs.

7. A method for stress peening leaf springs comprising the steps of:

conveying said leaf spring mounted on a first conveyor, said leaf spring mounted in its unstressed position;

conveying a spring deflecting element on a second conveyor;

engaging a portion of said leaf spring intermediate its ends with said spring deflecting element to deflect said spring in the direction of spring loading to a stressed condition;

conveying said stressed leaf spring to a passing area;

shot peening the side of said leaf spring which is in tension; and disengaging said spring deflecting element and said spring to allow said spring to return to its unstressed position.

* * * * *

UNITED STATES PATENT AND TRADEMARK OFFICE

CERTIFICATE OF CORRECTION

PATENT NO. : 4,337,632

DATED : July 6, 1982

INVENTOR(S) : Gerold Lienert

It is certified that error appears in the above—identified patent and that said Letters Patent is hereby corrected as shown below:

Column 3, Line 10 delete "magnanese" and insert --manganese--.

Column 3, Line 59 delete "releast" and insert --release--.

Signed and Sealed this

*Sixteenth* Day of *November 1982*

[SEAL]

*Attest:*

GERALD J. MOSSINGHOFF

*Attesting Officer*

*Commissioner of Patents and Trademarks*